US012108821B1

(12) United States Patent
Herrera

(10) Patent No.: US 12,108,821 B1
(45) Date of Patent: Oct. 8, 2024

(54) HEADBAND WITH ATTACHMENTS AND RELATED METHODS

(71) Applicant: Maria Herrera, Scottsdale, AZ (US)

(72) Inventor: Maria Herrera, Scottsdale, AZ (US)

( * ) Notice: Subject to any disclaimer, the term of this patent is extended or adjusted under 35 U.S.C. 154(b) by 50 days.

(21) Appl. No.: 17/220,172

(22) Filed: Apr. 1, 2021

Related U.S. Application Data

(60) Provisional application No. 63/038,696, filed on Jun. 12, 2020.

(51) Int. Cl.
*A41D 20/00* (2006.01)

(52) U.S. Cl.
CPC ..... *A41D 20/00* (2013.01)

(58) Field of Classification Search
CPC .... A41D 20/00; A41D 27/08; Y10T 24/1315; A47K 10/10; A47K 10/02; A47K 10/14; Y10S 2/11; A42B 1/241; A44C 25/00
See application file for complete search history.

(56) References Cited

U.S. PATENT DOCUMENTS 1,434,854 A * 11/1922 Stall ..... A41D 20/00 D2/894
2,615,168 A * 10/1952 Springer ..... A42B 1/241 2/209.3
3,760,461 A * 9/1973 Wright ..... A41D 13/0015 D6/601
4,244,057 A * 1/1981 Burnham ..... A41D 19/0037 2/160
4,277,847 A * 7/1981 Florio ..... A42C 5/02 2/209.3
4,403,366 A * 9/1983 Lucke ..... A47K 10/04 24/442
4,451,935 A * 6/1984 Henschel ..... A42B 1/241 2/253
4,462,116 A * 7/1984 Sanzone ..... A41D 20/00 2/253
4,499,741 A 2/1985 Harris
4,521,922 A * 6/1985 Mitchell ..... A42C 5/02 2/DIG. 11
4,797,793 A * 1/1989 Fields ..... A41D 20/00 362/105
4,852,189 A * 8/1989 Duggan ..... A61F 9/027 2/454
4,918,758 A * 4/1990 Rendina ..... G09F 7/12 2/919
5,014,360 A * 5/1991 Smith ..... A41D 31/18 2/125
5,046,195 A * 9/1991 Koritan ..... A41D 20/00 2/916

(Continued)

FOREIGN PATENT DOCUMENTS

CN 203168103 U 9/2013
CN 206240027 U 6/2017

(Continued)

*Primary Examiner* — Jillian K Pierorazio
(74) *Attorney, Agent, or Firm* — Nath, Goldberg & Meyer; Joshua B. Goldberg; Leia Dingott

(57) ABSTRACT

Implementations of headbands may include: a continuous length of fabric including a first side and a second side, a portion of hook material coupled with the first side of the continuous length of fabric, and a dabber. The dabber is configured to couple with the portion of hook material.

18 Claims, 5 Drawing Sheets

(56) References Cited

U.S. PATENT DOCUMENTS 5,136,726 A * 8/1992 Kellin ..... A43B 23/24 2/310
D329,021 S * 9/1992 Robbins ..... D3/226
5,146,630 A * 9/1992 Richard ..... A41D 20/005 2/171.2
5,269,720 A 12/1993 Moretz et al.
5,359,733 A * 11/1994 Brannon ..... A42B 1/248 2/209.13
5,539,929 A * 7/1996 Revson ..... A42B 1/241 2/175.1
5,581,813 A * 12/1996 Henschel ..... A42B 1/248 40/329
5,640,721 A * 6/1997 Jackson ..... A41D 20/00 2/209.13
5,724,698 A * 3/1998 Mondragon ..... A63B 55/20 15/210.1
5,826,598 A * 10/1998 Meehan ..... A45D 8/34 132/273
5,901,381 A * 5/1999 Nelson ..... A41D 20/00 2/244
6,170,087 B1 * 1/2001 Brannon ..... G09F 21/02 2/209.13
6,216,282 B1 * 4/2001 Marzec ..... A61F 9/026 2/452
6,519,779 B1 * 2/2003 Taguchi ..... A42B 1/248 2/209.12
6,688,316 B1 * 2/2004 Klug ..... A45D 8/002 211/13.1
7,165,272 B2 * 1/2007 Hudson ..... G02C 11/02 2/13
D690,886 S * 10/2013 Horick ..... D30/152
9,185,965 B1 * 11/2015 Bhati ..... A45F 5/00
9,930,919 B1 * 4/2018 Branker ..... A45D 8/24
2002/0066462 A1 * 6/2002 Denebeim ..... A45D 8/36 132/275
2005/0015849 A1 1/2005 Norment
2006/0249172 A1 * 11/2006 Ballew ..... A45D 8/36 132/275
2007/0051768 A1 * 3/2007 Dobson ..... A63B 47/04 224/919
2007/0234466 A1 * 10/2007 Stengel ..... A41D 20/00 2/160
2008/0190975 A1 * 8/2008 Naughton ..... A45F 5/02 15/210.1
2009/0032044 A1 * 2/2009 Grimm ..... A45D 8/12 132/273
2010/0078452 A1 * 4/2010 Grise ..... A41D 13/0051 224/0.5
2010/0178821 A1 * 7/2010 Morris ..... A47K 10/02 24/442
2010/0212685 A1 * 8/2010 Garza ..... A45D 8/36 132/273
2010/0277944 A1 * 11/2010 Hurwitz ..... A45D 8/36 2/244
2012/0246800 A1 * 10/2012 Liu ..... A45D 8/36 2/209.13
2013/0174320 A1 * 7/2013 Moye ..... A41D 20/00 2/170
2015/0082513 A1 * 3/2015 Wiseman ..... A63B 57/60 15/244.4
2015/0082514 A1 * 3/2015 Wiseman ..... A63B 71/146 15/244.4
2016/0000169 A1 1/2016 Bryski et al.
2016/0037840 A1 * 2/2016 Basik ..... A41D 20/00 2/170
2016/0206024 A1 * 7/2016 Madrid ..... A41D 31/12
2016/0270605 A1 * 9/2016 Jones-Felton ..... A47K 10/02
2016/0345706 A1 * 12/2016 Passarello ..... A45D 8/36
2017/0164676 A1 * 6/2017 Henrickson ..... A42B 1/24
2017/0245571 A1 * 8/2017 Csillag ..... A42B 1/004
2018/0042316 A1 * 2/2018 Wiseman ..... A63B 57/60
2018/0042325 A1 * 2/2018 Regan ..... A45F 3/04
2018/0103740 A1 4/2018 Kennedy
2018/0110277 A1 * 4/2018 Grossbard ..... A41G 5/0073
2018/0184723 A1 * 7/2018 Ricks ..... A41B 1/12
2018/0213866 A1 * 8/2018 Chien ..... A41D 15/005
2019/0060724 A1 * 2/2019 Farina ..... A63B 57/60
2019/0255403 A1 * 8/2019 Farina ..... A41F 1/002
2020/0404995 A1 * 12/2020 Schwartz ..... A41D 20/00
2021/0100408 A1 * 4/2021 Cheung ..... A47K 10/025

FOREIGN PATENT DOCUMENTS

JP H0987909 A 3/1997
JP 2010196230 A 9/2010

* cited by examiner

HEADBAND WITH ATTACHMENTS AND RELATED METHODS

CROSS REFERENCE TO RELATED APPLICATIONS

This document claims the benefit of the filing date of U.S. Provisional Patent Application 63/038,696, entitled "Headband with Attachments and Related Methods" to Maria Herrera which was filed on Jun. 12, 2020, the disclosure of which is hereby incorporated entirely herein by reference.

BACKGROUND

1. Technical Field

Aspects of this document relate generally to headbands, such as moisture wicking headbands for running, yoga, cycling, hiking, and other athletic events. More specific implementations involve headbands for gardening and other physical activities where a user may want to wipe their face in a quick manner.

2. Background

Conventionally, wiping sweat/perspiration while exercising or generally sweating/perspiring in any activity, the person will use a towel or whatever fabric material is available such as a piece of clothing including a shirt.

SUMMARY

Implementations of headbands may include: a continuous length of fabric including a first side and a second side, a portion of hook material coupled with the first side of the continuous length of fabric, and a dabber. The dabber is configured to couple with the portion of hook material.

Implementations of headbands may include one, all, or any of the following:

The headband may also include a pocket coupled on the first side of the continuous length of fabric. The pocket may be configured to hold and receive the dabber.

The portion of hook material may be a rectangular strip extending from the first end of the headband to the second end of the headband.

The portion of hook material may include one or more substantially circular shapes along a length of the first side of the headband.

The dabber may include a terry cloth material having loops to couple with the portion of hook material on the headband.

The dabber may include a folded towel in a fastened position.

Implementations of headbands may include: a headband having a first side and a second side. The first side may include a portion of hook material. The headband may also include a dabber configured to detachably couple with the headband. The headband may be configured to wrap around a user's head by removably fastening a first end of the headband with a second end of the headband.

Implementations of headbands may include one, all, or any of the following:

The headband may also include a pocket coupled on the first side of the continuous length of fabric. The pocket may be configured to hold and receive the dabber.

The portion of hook material may be a rectangular strip extending from the first end of the headband to the second end of the headband.

The portion of hook material may include one or more substantially circular shapes along a length of the first side of the headband.

The dabber may include a terry cloth material having loops to couple with the portion of hook material on the headband.

The dabber may include a folded towel in a fastened position.

Implementations of a personal moisture drying kit may include: a headband comprising a portion of hook material and a dabber. The dabber may be configured to be removably coupled with the headband.

The headband may be a length of material having a first end and a second end. The first end may be configured to removably couple with the second end.

The headband may be a continuous length of material configured to stretch to fit around the head of a user.

The headband may include one of microfiber, terry cloth, or cotton.

The kit may also include a pocket coupled with a first side of the headband. The pocket may be configured to hold and receive the dabber.

The dabber may include a terry cloth material having loops to couple with the portion of hook material on the headband.

The dabber may include a folded towel in a fastened position.

The dabber may include a moisture wicking material.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
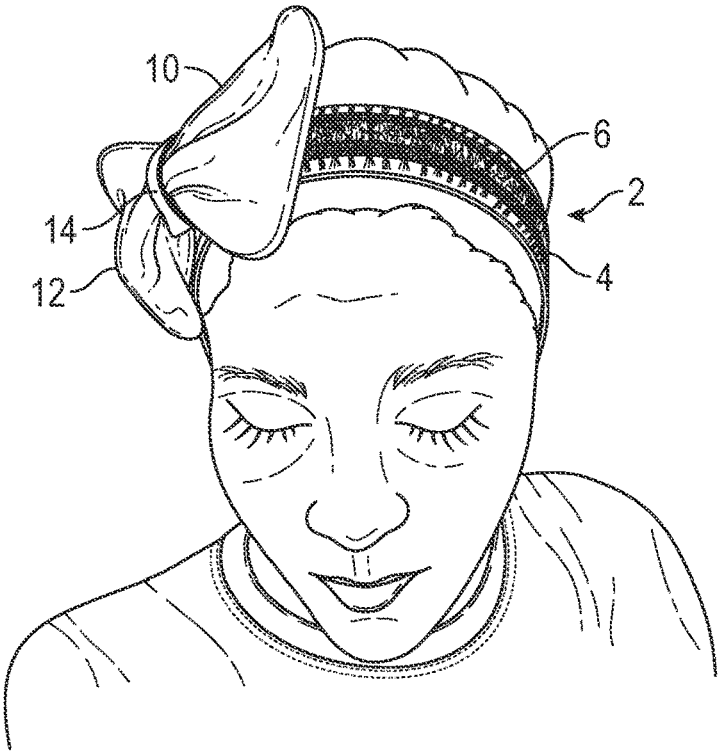
FIG. 1 is a perspective view of an implementation of an athletic headband on a head of a user.

This disclosure, its aspects and implementations, are not limited to the specific components, assembly procedures or method elements disclosed herein. Many additional components, assembly procedures and/or method elements known in the art consistent with the intended headbands will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such headbands, and implementing components and methods, consistent with the intended operation and methods.

As used herein the term "dabber" includes an article to be used for drying or blotting sweat or perspiration from a user's skin during exercise and other activities. A dabber may be used with a headband or other article of clothing. The headband or other article of clothing may have a portion of hook material from a hook and loop fastener to removably couple with the dabber. In various implementations, the hook material may be fixedly coupled with a number of items such as, by non-limiting example, hats, pants, shirts, bras, and other articles of clothing.

At various times, towels, shirts, or sweatbands have been used to blot or wipe sweat/perspiration while exercising or generally sweating/perspiring. It is desirable to improve athletic wear, headwear, and other similar items for wiping sweat/perspiration from a user's body including head, face, neck, arms, and other body parts where dripping sweat/perspiration can cause irritation to a user.

A difficult part of exercising, especially doing yoga or another similar activity is having sweat rolling down the forehead and into the eyes and mouth, and having to break pose/exercise or stopping the activity to reach for a towel and wipe the excess sweat. The headband system described herein may relate to a headband coupled with a 2-in-1 pull and toss towel/dabber aimed to allow frequent, quick and unobstructed, access to wipe excess perspiration with minimal disruption to an exercise routine. In various implementations, the element used to dry sweat or perspiration from the user's skin may include a towel, a sponge, a cloth, a dabber, or any other material that is capable of drying/removing sweat by light contact.

In various implementations a headband's material, may allow the towel or dabber to be easily attached and removed. The towel/dabber may be used for patting and wiping perspiration on the face or other parts of the body with minimal interference to exercise routine or positions. By non-limiting example, the headband and dabber may be used in hot yoga to remove sweat when a user becomes drenched with sweat during a pose. The dabber may be especially helpful to remove sweat/perspiration around the eyes and mouth during a one-minute pose. The headband may prevent sweat from obstructing a user's eyesight and the dabber may be almost immediately removed by a user to blot the sweat without any mechanical fastening required. The dabber may be used to absorb additional perspiration from dripping into the user's eyes and potentially reduce time spent blotting sweat rather than exercising. In some implementations, the dabber may include a pull and toss towel that may be taken apart for increased absorption.

In various implementations, the headband with dabber may reduce time spent reaching for a towel to pat and wipe a user's face during activities that may cause increased perspiration, without any fastening/unfastening required. This headband includes a quick drying headband coupled with a dabber made of a quick drying material such as by non-limiting example, microfiber, terry cloth, cotton, and other soft, quick drying materials. The dabber may be detached and reattached by a grab and release approach. The headband may be coupled around the head of a user and it may also be adjustable. The headband and towel/dabber combination may be worn like a traditional headband pulled over, or removably fastened around the head.

Figure 2:
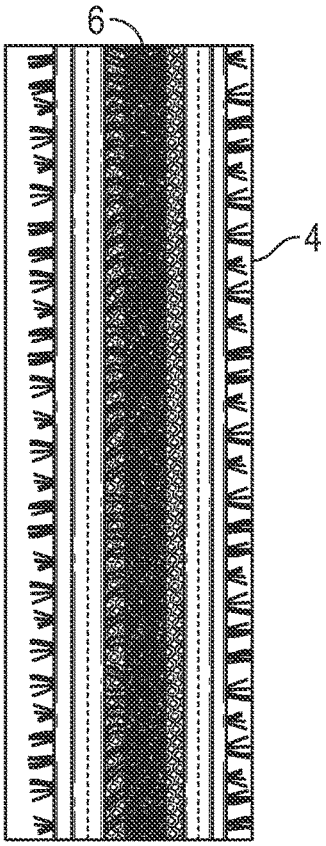
FIG. 2 is a top view of a first side of an implementation of a headband.

Referring to FIG. 1, an implementation of a headband 2 on a head of a user is illustrated. The headband includes a length of material having a first side and a second side; the second side is not illustrated as it usually unseen when the headband/device is in use. As illustrated, the headband is wrapped around the user's head. The headband may wrap around the user's head by removably fastening a first end of the headband with a second end of the headband. In other implementations, the headband may be a continuous length of fabric that is stretched around the head of a user. The first side of the headband includes a portion 6 of hook material. In some implementations, as illustrated in FIG. 2, the hook material 6 is a strip of material extending from the first end of the headband to the second end of the headband. In various implementations, the strip of hook material may be located in the middle of the headband, an equal distance between a first edge and a second edge of the headband. In other implementations, the strip of hook material may be closer to either the first edge or the second edge of the headband. In still other implementations, a portion 30 of hook material may include one or more substantially circular shapes 32 along a length of the first side of the headband as illustrated in FIG. 7.

Figure 3:
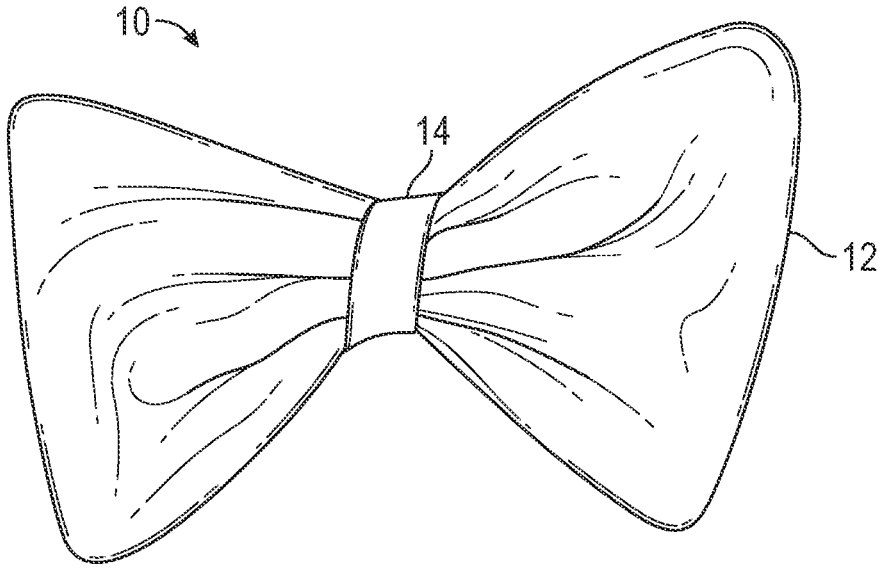
FIG. 3 is a top view of an implementation of a dabber in a folded position.
Figure 4:
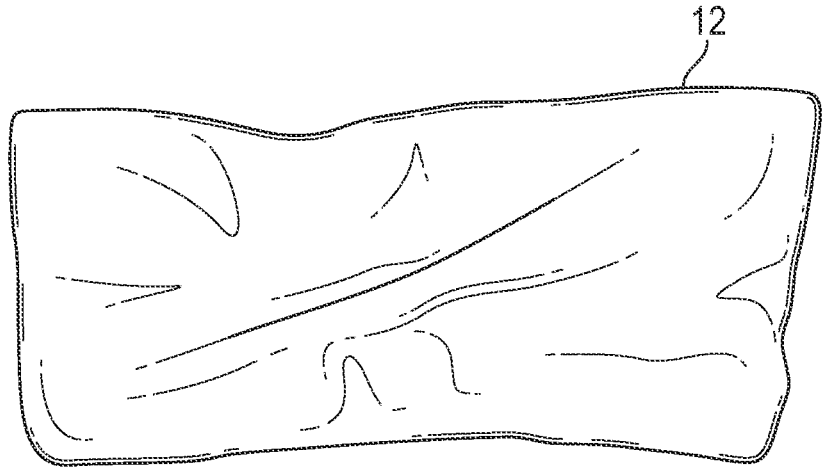
FIG. 4 is a top view of an implementation of a dabber in an unfolded position.
Figure 8:
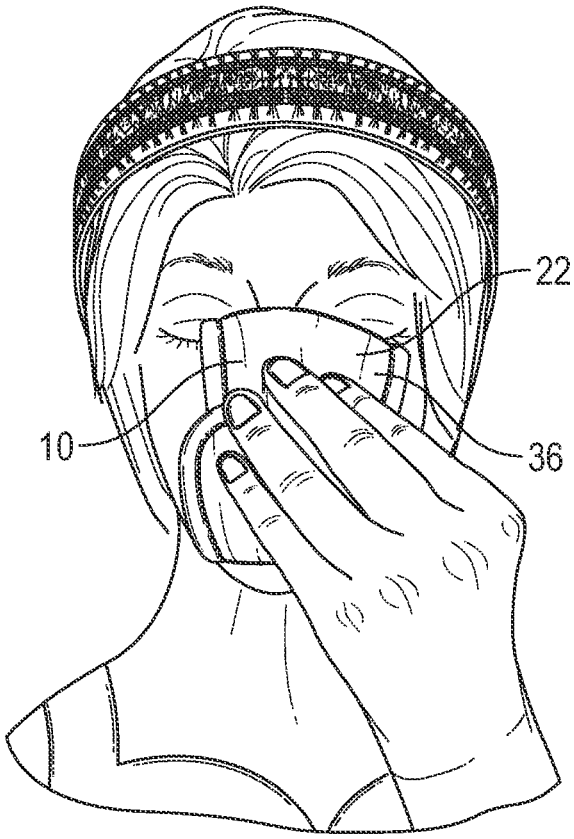
FIG. 8 is front view of an implementation of a dabber in use by a person.

The headband also includes a dabber 10 configured to detachably couple with the headband. The dabber may include a folded towel 12 in a fastened position. Referring to FIG. 3, an implementation of the dabber 10 in a bow shape is illustrated. Here, the dabber 10 is fastened with a piece of material 14 fastened around the middle of the towel 12 to form a bow shape. The piece of material 14 may include hook and/or loop material to couple with the headband. In other implementations the dabber may have a different shape in a folded position. Referring to FIG. 4, the implementation of the dabber is illustrated in an unfolded position. The dabber may be formed of a material with loops to easily couple with the headband while a user is exercising. In various implementations, the dabber may be formed of terry cloth or other moisture wicking material. Referring to FIG. 8, an example of a user using one of various implementations of a dabber 10, 22, and 36 is illustrated.

Figure 5:
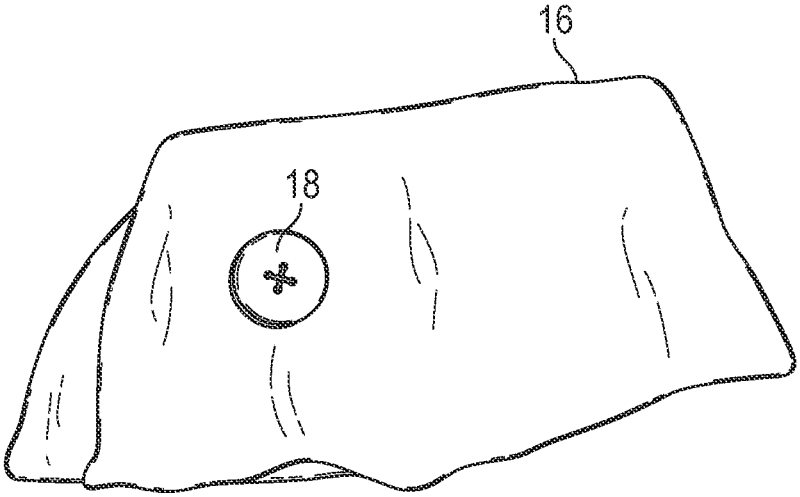
FIG. 5 is a top view of another implementation of a dabber in a folded position fastened with a button fastener.
Figure 6:
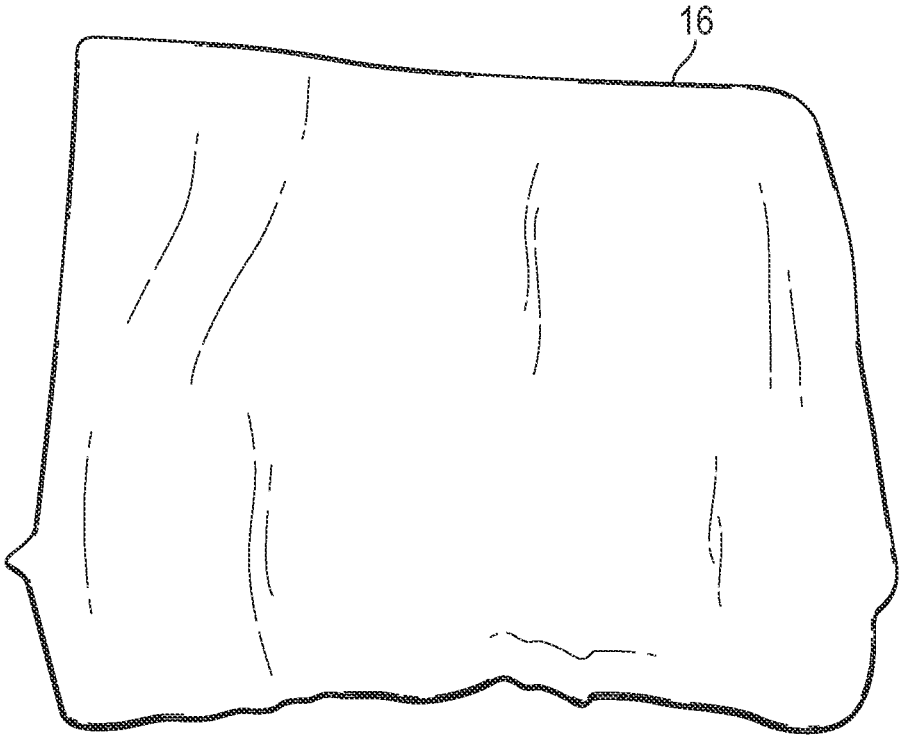
FIG. 6 is a top view of another implementation of a dabber in an unfolded position.

Referring to FIGS. 5 and 6, another implementation of a dabber 16 is illustrated. In this implementation, the dabber is a towel and is secured in a folder position by a button fastener 18. In this implementation, it is likely the dabber would remain in a folded position for quick removal of perspiration from a user's forehead. By non-limiting example, the dabber may be unfolded when the user has a longer time to wipe themselves or at the end of a workout or other activity that results in a high rate of perspiration. In other implementations, another type of fastener used to hold the dabber in the folded position may be used such as a hook and eye fastener, a magnetic fastener, a hook and loop fastener, or other fasteners that would allow a small size and keep a small piece of cloth such as a towel in a folded position.

Figure 7:
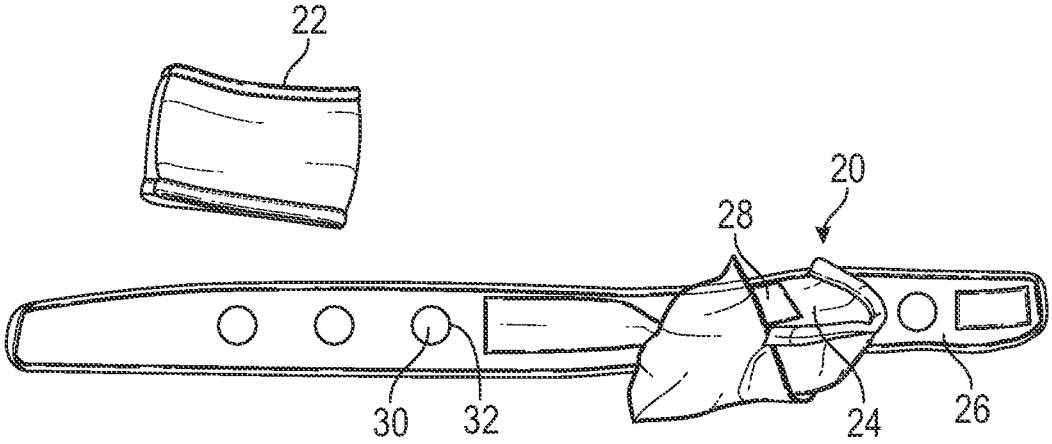
FIG. 7 is an implementation of a personal moisture drying kit including a headband having a pocket coupled to a front side of the headband and a dabber.

Referring to FIG. 7, another implementation of a headband is illustrated. Referring to FIG. 7, another implementation of a headband 20 having a dabber 22 accessory is illustrated. In this particular implementation, a pocket 24 is formed on a first side 26 of the headband. The pocket may be used to hold the dabber while a user is exercising. As illustrated, a hook portion 28 of a hook and loop fastener is positioned within the pocket 24 to provide a more stable attachment for the dabber 22 during strenuous exercise. In various implementations, the pocket may support and store the dabber without an additional fastener inside the pocket. In this implementation of a headband having a dabber accessory, the pocket is capable of cradling the dabber when a user tosses the dabber toward the headband after having wiped/dried his/her forehead. In some implementations, the pocket may be ornamental and may have a fabric design such as a flower on an outer edge of the pocket as illustrated. In other implementations, the fabric design may have another shape.

Still referring to FIG. 7, the headband with accessory includes hook portions 30 of a hook and loop portion on other portions of the headband 20. As illustrated the hook portions may have a substantially circular shape. In other implementations, the portions of hook material may have other shapes such as, by non-limiting example, squares, rectangles, and other polygons which can be decorative and functional. In various implementations, the headband may be formed a material having loops and the dabber may include a hook portion of a hook and loop fastener allowing the dabber to be tossed to any location on the headband.

In various implementations, a personal drying kit may include a headband having a portion of hook material and a dabber configured to removably couple with the headband through the portion of hook material. As previously described, in some implementations, the headband may include a continuous length of material. In other implementations, the headband may have a first end and a second end and may wrap around a user's head by removably fastening/coupling a first end of the headband with the second end of the headband.

Figure 9:
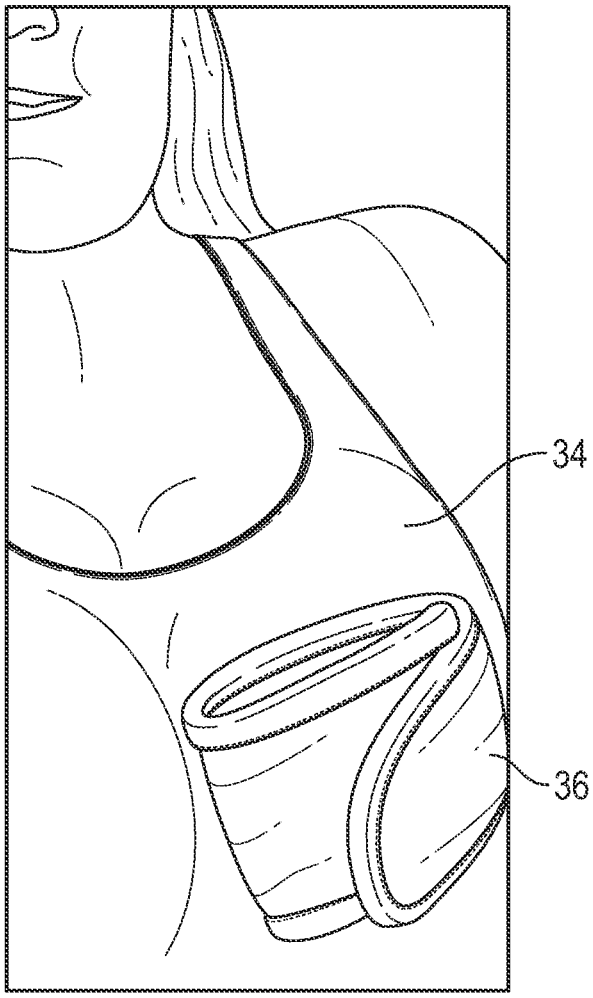
FIG. 9 is a front view of an implementation of a personal moisture drying kit including a sports bra having dabber removably coupled thereto.

Referring to FIG. 9, another implementation of a personal drying system includes an implementation of a sports bra 34 having a dabber 36 is illustrated. The dabber 36 accessory may be removably coupled with the sports bra through hooking pads. In various implementations, the hooking pads are made of a hook portion of a hook and loop fastener. The sports bra 34 with dabber attachment includes a similar method to the headband with dabber accessory. In this implementation, the dabber may have a folded over or rolled up appearance and structure. In other implementations, the dabber used with a sports bra may have any other shape and structure as described herein. In still other implementations, the dabber may have any shape and structure that allows a user to dry perspiration off her face as illustrated in FIG. 8 and toss the dabber towards the bra to couple the dabber with the bra during exercise. By non-limiting example, the dabber is lightly but firmly coupled with the sports bra to ensure the dabber will stay in the desired position when a user is exercising. The user may easily remove the dabber from the sports bra during exercise such as, by non-limiting example, yoga, running, and other activities that may cause a large amount of sweat/perspiration to drip down a user's face. Specifically, in cycling, the various implementations of personal drying systems described herein are desirable to provide a specific location for a drying device such as the headband or sports bra instead of having to place a towel or other material on the handle bar or other location on a bicycle. Keeping the dabber on the person of a user may be more hygienic than placing a towel on the bicycle itself. In various implementations, the dabber may be formed of a terry cloth, microfiber cloth, or other cloth with texture for the hook portion to couple with. In various implementations, the dabber towel system may be combined with any article of athletic clothing such as, by non-limiting example, pants, shorts, a shirt, and a hat. In other implementations, the dabber and towel system may also be combined with other non-athletic articles of clothing such as hats, shirts, pants, shorts, and other clothing items.

In places where the description above refers to particular implementations of headbands and implementing components, sub-components, methods and sub-methods, it should be readily apparent that a number of modifications may be made without departing from the spirit thereof and that these implementations, implementing components, sub-components, methods and sub-methods may be applied to other headbands.

What is claimed is:

1. A headband comprising:

a continuous length of fabric comprising a first side and a second side;

a portion of hook material extending from a first end of the headband to a second end of the headband, where in the portion of hook material is coupled with the first side of the continuous length of fabric; and a dabber, the dabber configured to removably couple with the portion of hook material when tossed by a user; wherein the dabber is a looped terry cloth material configured to directly couple with the portion of hook material on the headband.

2. The headband of claim 1, further comprising an open pocket having a fixed opening, the open pocket coupled on the first side of the continuous length of fabric, the open pocket configured to hold and receive the dabber for stability.

3. The headband of claim 1, wherein the portion of hook material is a rectangular strip.

4. The headband of claim 1, wherein the portion of hook material includes one or more substantially circular shapes along a length of the first side of the headband.

5. The headband of claim 1, wherein the dabber comprises a folded towel in a fastened position.

6. An athletic headband comprising:

a headband comprising a first side and a second side, the first side comprising a portion of hook material extending from a first end of the headband to a second end of the headband; and a dabber configured to detachably couple with the headband when tossed by a user;

wherein the dabber is a looped terry cloth material configured to directly couple with the portion of hook material on the headband;

wherein the headband is configured to wrap around a user's head by removably fastening the first end of the headband with the second end of the headband.

7. The headband of claim 6, further comprising an open pocket having a fixed opening, the open pocket coupled on the first side of the headband, the open pocket configured to hold the dabber for stability.

8. The headband of claim 6, wherein the portion of hook material is a rectangular strip.

9. The headband of claim 6, wherein the portion of hook material includes one or more substantially circular shapes along a length of the first side of the headband.

10. The headband of claim 6, wherein the dabber comprises a folded towel in a fastened position.

11. A personal moisture drying kit comprising:

a headband comprising a portion of hook material; and a dabber, the dabber configured to be removably coupled with the headband when tossed by a user;

wherein the dabber is a looped terry cloth material configured to directly couple with the portion of hook material on the headband.

12. The kit of claim 11, wherein the headband is a length of material having a first end and a second end, the first end configured to removably couple with the second end.

13. The kit of claim 11, wherein the headband is a continuous length of material configured to stretch to fit around the head of a user.

14. The kit of claim 11, wherein the headband comprises one of microfiber, terry cloth, or cotton.

15. The kit of claim 11, further comprising an open pocket having a fixed opening, the open pocket coupled with a first side of the headband, the open pocket configured to cradle and receive the dabber for stability.

16. The kit of claim 11, wherein the dabber includes a terry cloth material having loops to couple with the portion of hook material on the headband.

17. The kit of claim 11, wherein the dabber comprises a folded towel in a fastened position.

18. The kit of claim 11, wherein the dabber comprises a moisture wicking material.

* * * * *